US012357100B2

(12) United States Patent
Chunglo

(10) Patent No.: US 12,357,100 B2
(45) Date of Patent: Jul. 15, 2025

(54) MATTRESS ASSEMBLIES INCLUDING PHASE CHANGE MATERIALS AND PROCESSES TO DISSIPATE THERMAL LOAD ASSOCIATED WITH THE PHASE CHANGE MATERIALS

(71) Applicant: DREAMWELL, LTD., Doraville, GA (US)

(72) Inventor: Christopher Chunglo, Marietta, GA (US)

(73) Assignee: DREAMWELL, LTD., Doraville, GA (US)

( * ) Notice: Subject to any disclaimer, the term of this patent is extended or adjusted under 35 U.S.C. 154(b) by 420 days.

(21) Appl. No.: 17/488,829

(22) Filed: Sep. 29, 2021

(65) Prior Publication Data

US 2023/0102164 A1 Mar. 30, 2023

(51) Int. Cl.

| | |
|---|---|
| ***A47C 27/08*** | (2006.01) |
| ***A47C 21/04*** | (2006.01) |
| ***A47C 27/14*** | (2006.01) |
| ***A47C 27/15*** | (2006.01) |

(52) U.S. Cl.

CPC ..... *A47C 27/085* (2013.01); *A47C 21/046* (2013.01); *A47C 27/144* (2013.01); *A47C 27/15* (2013.01)

(58) Field of Classification Search

CPC ..... A47C 27/085; A47C 27/144; A47C 27/15; A47C 27/20; A47C 21/044; A47C 21/046; A47C 31/006

USPC ..... 5/655.5

See application file for complete search history.

(56) References Cited

U.S. PATENT DOCUMENTS

| | | | | |
|---|---|---|---|---|
| 5,837,002 | A * | 11/1998 | Augustine | A61F 7/10 607/104 |
| 6,319,599 | B1 * | 11/2001 | Buckley | C09K 5/063 36/83 |
| 6,699,266 | B2 * | 3/2004 | Lachenbruch | A61G 7/05715 607/108 |
| 8,832,888 | B2 * | 9/2014 | Chunglo | A47C 27/146 5/724 |
| 8,997,279 | B1 * | 4/2015 | Mckay | A47C 21/048 5/652.2 |
| 2005/0278863 | A1 * | 12/2005 | Bahash | A47C 21/044 5/652.2 |
| 2014/0033441 | A1 * | 2/2014 | Morgan | A47C 31/006 5/724 |
| 2014/0189951 | A1 * | 7/2014 | DeFranks | A47C 21/044 5/423 |
| 2017/0020299 | A1 * | 1/2017 | Valenta | A47C 21/046 |

(Continued)

FOREIGN PATENT DOCUMENTS

| | | | | |
|---|---|---|---|---|
| KR | 20100031142 | A * | 3/2010 | A47C 21/04 |

*Primary Examiner* — David R Hare

(74) *Attorney, Agent, or Firm* — CANTOR COLBURN LLP

(57) ABSTRACT

Mattress assemblies including phase change materials and processes for dissipating retained in the mattress assemblies generally include a spacer layer in proximity to one or more foam layers containing a phase change material; and a pump in fluid communication with the spacer layer to provide a positive or negative air flow into the spacer layer to reduce retained heat in the phase change materials subsequent to a sleep cycle. The process includes operating the pump between sleep cycles to reduce the retained heat.

23 Claims, 3 Drawing Sheets

(56) References Cited

U.S. PATENT DOCUMENTS

| | | | | |
|---|---|---|---|---|
| 2017/0202362 | A1* | 7/2017 | Reynolds | A47C 19/025 |
| 2018/0279796 | A1* | 10/2018 | Valenta | A47C 27/122 |
| 2019/0053634 | A1* | 2/2019 | Chirackal | D01F 6/46 |
| 2020/0260882 | A1* | 8/2020 | Chunglo | A47C 27/148 |
| 2021/0161301 | A1* | 6/2021 | Smiderle | A47C 21/06 |

* cited by examiner

MATTRESS ASSEMBLIES INCLUDING PHASE CHANGE MATERIALS AND PROCESSES TO DISSIPATE THERMAL LOAD ASSOCIATED WITH THE PHASE CHANGE MATERIALS

BACKGROUND

The present disclosure generally relates to mattress assemblies including phase change materials, and more particularly, to high thermal mass mattress assemblies including phase change materials and processes configured to dissipate thermal load associated with the phase change materials between sleep cycles.

Phase change is a term used to describe a reversible process in which a solid turns into a liquid or a gas. The process of phase change from a solid to a liquid requires energy to be absorbed by the solid. When a phase change material ("PCM") liquefies, energy is absorbed from the immediate environment as it changes from the solid to the liquid. In contrast to a sensible heat storage material, which absorbs and releases energy essentially uniformly over a broad temperature range, a phase change material absorbs and releases a large quantity of energy in the vicinity of its melting/freezing point. Therefore, a PCM that melts below body temperature would feel cool as it absorbs heat, for example, from a body. Phase change materials, therefore, include materials that liquefy (melt) to absorb heat and solidify (freeze) to release heat. The melting and freezing of the material typically take place over a narrow temperature range.

PCMs have become increasingly popular for use in mattress applications to provide comfort to an end user. The PCMs are typically applied to foam layers proximate to a sleeping surface. During use, the PCMs are designed to absorb body heat that is released during the night from an end user to provide a cooling sensation. The absorbed heat is stored within the PCM. Then as the end user's body temperature lowers and cools off, the PCM will slowly release that heat to maintain body temperature.

BRIEF SUMMARY

Disclosed herein are mattress assemblies and processes for dissipating retained heat from phase change materials or any other high thermal mass material during a sleep cycle. In one or more embodiments, the mattress assembly includes one or more foam layers containing a phase change material, the one or more foam layers spanning at least a portion of a length and/or a width of the sleeping surface; an air permeable layer in proximity to the one or more foam layers containing the phase change material; and a pump comprising a conduit, wherein the conduit is in fluid communication with the spacer layer, and wherein the pump is configured to provide positive air flow or negative air flow into the air permeable layer to dissipate a thermal load associated with the phase change material in the one or more foam layers.

In one or more other embodiments, the mattress assembly includes a topper layer overlying a mattress body, the topper layer comprising one or more foam layers, wherein at least one foam layer comprises a plurality of channels and a macroencapsulated phase change material disposed in at least one or the channels, the macroencapsulated phase change material comprising a sealed flexible capsulate, a permeable material within the capsulate, and a phase change material infused within the permeable material; a spacer layer abutting the at least one foam layer comprising the plurality of channels and the macroencapsulated phase change material disposed in at least one or the channels; a pump in fluid communication with the spacer layer via a conduit, wherein the pump is configured to provide a positive air flow or a negative air flow, and wherein the conduit is fluidly coupled to a perforated conduit within the spacer layer including perforations directed at the macroencapsulated phase change material in at least one or the channels.

In one or more other embodiments, the process for dissipating retained heat from a phase change material provided in at least one foam layer of a mattress assembly, wherein the heat is retained during a first sleep cycle. The process comprises providing an air permeable layer in the mattress assembly, wherein the air permeable layer is in proximity to the at least one foam layer containing the phase change material; and negatively or positively flowing air from a pump after the first sleep cycle and prior to an additional sleep cycle into the air permeable layer via a conduit in fluid communication The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Figure 1:
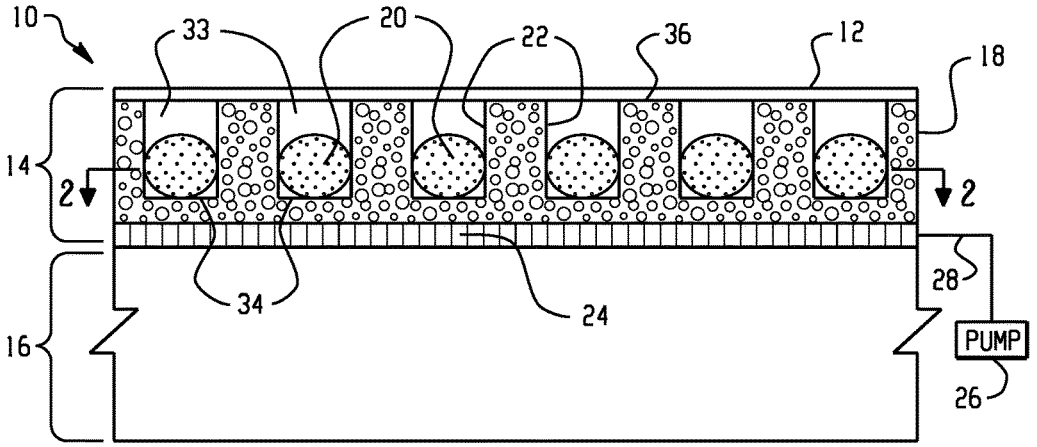
FIG. 1 illustrates a cross-sectional view of a mattress assembly in accordance with an embodiment of the present disclosure.

Disclosed herein are mattress assemblies including at least one foam layer including phase change materials and a spacer layer proximate to the at least one foam layer including the phase change materials. The phase change materials can be microencapsulated and uniformly or non-uniformly distributed on and/or within a foam layer or can be macroencapsulated, wherein a bulk amount of phase change material is encapsulated and provided within a recessed location in and/or within the foam layer.

Microencapsulated phase change materials and methods of microencapsulation are well known in the art. Microencapsulated phase change materials generally include an outer shell, i.e., capsule, such as an acrylic polymer shell and a relatively small amount of a phase change material within the shell. The microencapsulated phase change materials generally have particle sizes ranging from about 1 micron to about 25 microns. The loading is generally dependent on density and thickness of the foam layer. The microencapsulated phase change materials can be sprayed onto the foam surfaces and/or infused into the foam structure. For bedding applications, microencapsulated phase change materials are generally on the order of a few grams or micrograms per square foot. In contrast, macroencapsulation generally refers to encapsulation of relatively large amounts on the order of grams or more. In one or more embodiments, the amount of phase change material in the encapsulated bulk phase change material is at least 100 grams per square foot of surface area, greater than about 400 grams per square foot in other embodiments, and greater than about 800 grams per square foot in still other embodiments.

In one or more embodiments, the encapsulated bulk phase change material(s) 400 further may include a permeable material 406 such as an open cell foam disposed within the capsulate, wherein the permeable material can be infused with the bulk phase change material or materials and inserted into the capsulate prior to sealing of the capsulate.

The use of phase change materials, especially when used in multiple foam layers having relative high densities and with the phase change materials at different depths within the mattress assembly, can result in a mattress assembly exhibiting a high thermal mass. Unexpectedly, it has been discovered that the high thermal mass associated with mattress assemblies that include phase change materials can result in high thermal loading of the layers containing the phase change materials subsequent to a sleep cycle that slowly dissipates over an extended period of time since the use of foam about the phase change materials is an effective insulator. It has been discovered that the dissipation time for the heat absorbed by the phase change materials during a sleep cycle can overlap with the next sleep cycle by the end user. For example, the thermal load from a single sleep cycle may not completely dissipate in time for the next sleep cycle, which can occur within about 8 to about 12 hours or more later. The retention of the thermal load can reduce the effectiveness of the phase change materials and significantly impact the thermal performance. The retained heat can cause a gradual degradation of the thermal performance of the bed, which will generally depend on the thermal mass associated with the bed. In traditional mattress assemblies, the thermal mass tends to be relatively low since low density and/or open cell foams and/or coil innersprings are oftentimes used. Because the traditional mattress assemblies do not retain much heat after use, the traditional mattress assemblies don't need to dissipate large amounts of heat to come back to the environmental temperature. In contrast, high thermal mass mattress assemblies such as those including phase change materials, high-density foams, closed cell foams, as well as those mattress assemblies with taller profiles can retain the heat after a sleep cycle over a much longer period of time, which is exacerbated with the use of blankets, comforters, and the like.

In the present disclosure, the mattress assemblies are generally configured to dissipate the thermal load completely or substantially to maximize the effectiveness of the phase change materials from one sleep cycle to the next sleep cycle. As will be described in greater detail below, the mattress assemblies are generally configured to include a spacer layer, or a highly permeable layer that will not significantly impede the air flow such as a reticulated foam, proximate to the lowest foam layer containing the phase change material or any high thermal mass material. The spacer layer is in fluid communication with a pump configured to provide a positive or negative air pressure in the spacer layer between sleep cycles, i.e., during periods of non-use. The flow of air into or out of the mattress assembly provides effective dissipation of the thermal load that may have been retained by the phase change materials during a sleep cycle. As such, the pump is generally configured to operate during non-use of the mattress assembly to reduce the thermal load from the previous sleep cycle. In this manner, consistent and maximal performance of the phase change materials from one sleep cycle to the next sleep cycle can advantageously be obtained.

In one or more embodiments, the uppermost layers of a mattress assembly are contained within a topper layer structure, which may be removable. To maximize the benefits associated with the use of phase change materials, the topper layer can include one or more layers including the phase change material, which can be microencapsulated or macroencapsulated. The spacer layer can be provided near the layers containing the phase change material, e.g., within the topper layer, underlying the topper layer, or the like. In some embodiments, the spacer layer may be sandwiched between foam layers containing phase change materials. In other embodiments, the spacer layer can underlie the lowermost layer containing the phase change materials. A pump is in fluid communication with the spacer layer and is configured to pull a vacuum or provide positive airflow to remove heat from the layers containing the phase change materials. As noted above, the pump can be operated during periods of non-use so that the sleep experience is not interrupted, and the performance of the phase change materials is consistent from one sleep cycle to the next sleep cycle. In prior art mattress assemblies, the heat absorbed by the phase change materials can be at least partially retained from one sleep cycle to the next, which reduces the effectiveness of the phase change material making the sleep experience inconsistent from one sleep cycle to the next sleep cycle.

As used herein, the term "spacer layers", also referred to as spacer fabric layers, are generally three-dimensional structures defined by randomly oriented polymeric fibers or pile yarns that define a significant number of voids, i.e., a relatively large amount of free volume, which is generally defined as the amount of free space per unit area, wherein free space is defined as an area not occupied by polymer and is also referred to herein as voids or interstitial space.

As used herein, the term "transition time" generally refers to the time of the transition of the phase change material per unit cell volume of the phase change material during use by an end user on the mattress. For example, an end user would feel cool as the phase change material absorbs heat from the end user during the sleep cycle. In the present disclosure, an encapsulated bulk amount of phase change material or materials provided within a channel can be calculated to provide cooling or heating from about 30 minutes to about 8 hours or longer.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e., occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Figure 2:
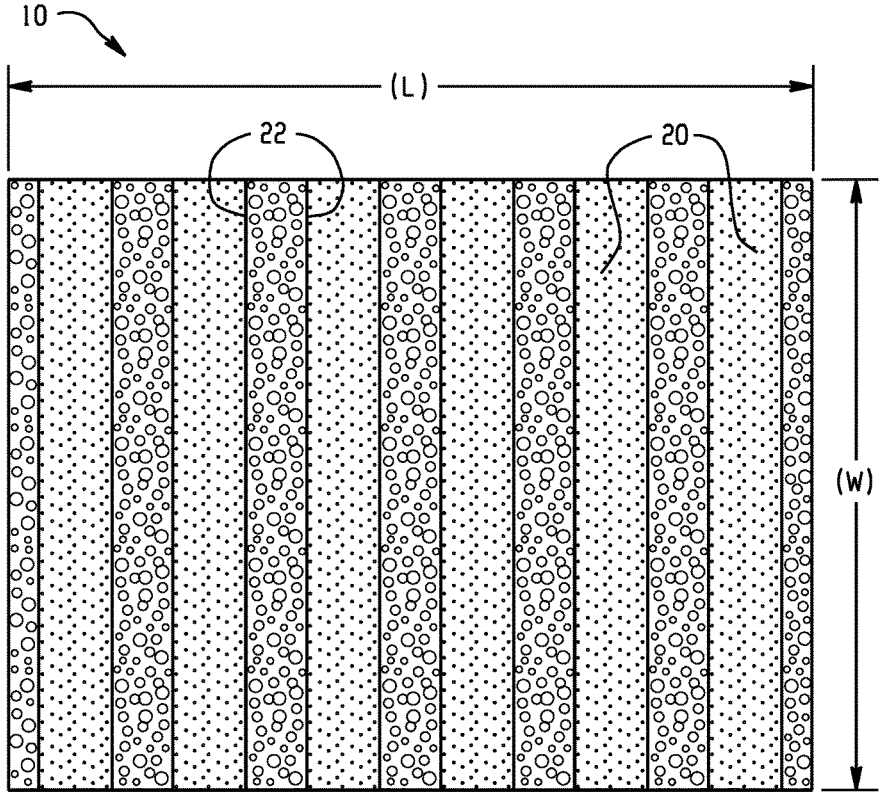
FIG. 2 illustrates a top-down view of the mattress assembly of FIG. 1 taken along lines 2-2 in accordance with an embodiment of the present disclosure.

Referring now to FIG. 1, there is depicted a cross-sectional view of a mattress assembly 10 including a cover layer 12, a topper layer 14 underlying the cover layer 12, and a mattress body 16 underlying the topper layer 14. FIG. 2 illustrates a top-down view of the mattress assembly 10 taken along lines 2-2 of FIG. 1.

The illustrated topper layer 14 overlies the mattress body 16 and includes at least one foam layer 18 including a phase change material 20. As shown, the topper layer 14 includes a single foam layer 18 that includes a macroencapsulated phase change material 20 disposed within channels 22 and a spacer layer 24 underlying the foam layer 18 with a macroencapsulated phase change material. It should be apparent that more than one layer including or not including the phase change material(s) can be utilized. A pump 26 is fluidly connected to the relatively large interstitial spaces provided within the spacer layer 24 via a conduit 28. The conduit 28 can extend from the pump 26 and into the spacer layer 24. More than one conduit and/or pump can be utilized. Moreover, the conduit can be fluidly connected to a manifold to distribute the air flow or pull a vacuum across a relatively large surface area. The conduit 28 can include perforations along its length within the spacer layer 24 to permit air flow into or out of the spacer layer 24 depending on whether the pump 26 is configured to provide positive or negative air flow. As such, the pump 26 itself can be unidirectional or bidirectional in terms of air flow. The flow of air into or out of the spacer layer advantageously can help remove heat absorbed by the phase change material containing layers during a sleeping cycle. Although a spacer layer 24 is referenced herein, it should be apparent that any highly permeable layer that will not significantly impede the air flow can be used such as, for example, open cell foams, reticulated foams, and the like.

Suitable open cell foams can have a non-random large cell structure or a random cellular structure with many large cells. The open cell foam structure includes a plurality of interconnected cells, wherein the windows between the adjacent cells are broken and/or removed. In contrast, a closed cell foam has substantially no interconnected cells and the windows between the adjacent cells are substantially intact. In reticulated foams, substantially all of the windows are removed.

The pump 26 can be programmed to actuate during a non-sleep cycle. For example, the mattress assembly can include one or more sensors. For example, a load sensor or the like to detect occupancy of the mattress assembly and actuate the pump when a load is not detected. In another example, a humidity sensor can be utilized to detect the amount of humidity within the mattress assembly and compare this to the ambient humidity in the environment in which the mattress assembly is located. The pump can be actuated when the humidity within the mattress assembly is levitated relative to the ambient humidity. Still further, a temperature sensor can be used to measure the amount of retained heat within the mattress assembly and compare this to the ambient temperature. The pump can be actuated when the temperature is elevated relative to the ambient temperature.

The foam layer including the phase change material can be an open cell foam or can include conduits formed in the foam layer to increase the efficiency of heat dissipation. It should be apparent that the spacer layer can be provided to define separate zones for mattresses configured for two occupants. In this manner, pumps for each zone can provided with each pump configured to provide a customized thermal profile for a specific user. For example, a user that sleeps "hot" may want most if not all heat removed prior to a sleep cycle whereas a person that does not sleep hot may desire the pump to operate a much less extent or possibly not at all, i.e., retain some or all of the heat from a prior sleep cycle for the next sleep cycle.

The cover layer 12 is optional and is generally the uppermost foam layer and has a planar top surface adapted to substantially face a user resting on the mattress assembly and overlays the topper layer 14. The cover layer 12 generally has length and width dimensions sufficient to support a reclining body of the user. The cover layer 12 is not intended to be limited and can be formed of foam, fibers, mixtures thereof, or the like. In one or more embodiments, the cover layer can be formed from viscoelastic foam or non-viscoelastic foam depending on the intended application. The foam itself can be of any open or closed cell foam material including without limitation, latex foams, natural latex foams, polyurethane foams, viscoelastic foams, combinations thereof, and the like. The thickness of the cover layer is generally within a range of about 0.5 to 2 inches in some embodiments, and less than 1 inch in other embodiments so as to provide the extended cooling benefits of the underlying layer including the channels and the encapsulated bulk phase change material or materials. The density of the cover layer 12 can be within a range of 1 to 8 $lb/ft^3$ in some embodiments, and 2 to 4 $lb/ft^3$ in other embodiments. The hardness is within a range of about 7 to 28 pounds-force in some embodiments, and less than 15 pounds-force in other embodiments. In one or more embodiments, the cover layer can be configured as a quilt panel or a convoluted foam.

The topper layer 14 is generally parallelpiped-shaped having a length (L) dimension and a width (W) dimension that can be configured to approximate the length and width dimension of the mattress body 16. The illustrated topper layer 14 can be composed of one or more layers and generally has a thickness equal to or less than 6 inches in one or more embodiments, a thickness equal to or less than 5 inches in other embodiments, or a thickness equal to or less than 4 inches in still other embodiments. In other embodiments, the thickness of the topper layer is greater than or equal 1 inch. The topper layer 14 can be removable or fixedly attached to the underlying mattress body 16 such as by an adhesive. In some embodiments, the topper layer 14 can be removably contained within a zippered covering (not shown) that can be zippered to the mattress body 16.

As shown in FIG. 2, the plurality of channels 22 extend from one side of the layer to the other side. In one or more embodiments, the channels 22 are uniformly spaced apart within a selected surface and parallel to one another extending transversely from one side to another side of the width dimension (W) as shown. In one or more other embodiments, the channels 22 can longitudinally extend from one side to another side of the length dimension (not shown) and/or are non-uniformly spaced apart and/or are not parallel to one another.

Each of the channels 22 has a depth that is a fraction of a total thickness of the topper layer 14. In one or more embodiments, the depth of the channels 22 is about 90% or less than the thickness of the topper layer 14. In one or more other embodiments, the depth of the channels 22 is about 80% or less than the thickness of the topper layer 14, and in still one or more embodiments, the depth of the channels is about 70% or less than the thickness of the topper layer 14. In one or more embodiments, each of the channels 22 can have the same depth or have different depths depending on the intended application. In one or more embodiments, different depths can be employed to provide zoning. Similarly, the channels can be selectively located to provide zoning to correspond to the head region, the lumbar region, and/or the leg and foot region of the mattress assembly 10.

Disposed within each of the channels 22 is a macroencapsulated phase change material, i.e., an encapsulated bulk amount of a phase change material 20 or a bulk mixture of phase change materials sealing disposed within a preformed capsulate. Although the encapsulated bulk phase change material 20 is shown spanning the entire channel 22, it should be apparent that the encapsulated bulk phase change material 20 can be configured to span a portion thereof. Advantageously, the encapsulated bulk phase change material 20 provides extended cooling as needed to an end user of the mattress assembly 10.

As shown, each of the encapsulated bulk phase change material 20 provided within a given channel 22 is tubular shaped and is seated on a bottom surface 34 of the respective channel 22. The encapsulated bulk phase change material 20 can have a dimension that is a fraction of the depth of the channel 22 such that an optional space 33 is provided above the encapsulated bulk phase change material 20 relative to the uppermost surface 36 of the topper layer 14 as shown and/or can completely fill a respective channel 22. In one or more embodiments, the space 33 is generally greater than 0 to less than about 95 percent of the channel depth, i.e., the encapsulated bulk phase change material is greater than 0 to about 25 percent of the channel depth (D). In one or more other embodiments, the space 33 is greater than 0 to less than about 50 percent of the channel depth, and in still one or more other embodiments, the space 33 is less than 25 percent of the channel depth.

In one or more embodiments, the encapsulated bulk phase change material 20 is provided in channels 22 having different depths (not shown), so that the encapsulated bulk phase change material can be activated at different times, e.g., the encapsulated bulk phase change material 20 closest to the sleeping surface (i.e., closest to the cover layer 12) will activate earlier than the encapsulated bulk phase change material farther away from the sleeping surface. Other variations are disclosed in U.S. patent application Ser. No. 17/479,622 entitled, MATTRESS ASSEMBLIES INCLUDING PHASE CHANGE MATERIALS, filed on Sep. 20, 2021, which is incorporated herein by reference in its entirety.

The cover layer 12 and the topper layer 14 collectively overlie the mattress body 16. The mattress body 16 is not intended to be limited and can include one or more layers including foam layers, fiber layers, coil layers, air bladders, various combinations thereof, and the like. Generally, the mattress body 16 can have a thickness be greater than 4 inches to less than 12 inches although greater or lesser thicknesses can be used. Suitable foam layers include, without limitation, synthetic and natural latex, polyurethane, polyethylene, polypropylene, and the like. Optionally, in some embodiments, one or more of the foam layers may be pre-stressed such as is disclosed in U.S. Pat. No. 7,690,096, incorporated herein by reference in its entirety. The coil layers generally include coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

The mattress assembly 10 can further include a side rail assembly (not shown) about all or a portion of the perimeter of at least by the mattress body 16 and optionally the cover and topper layers, 12,14, respectively. In some embodiments, the cover layer and the topper layer overlay the mattress body and the side rail assembly. The side rails that define the assembly may be attached to or placed adjacent to at least a portion of the perimeter of the mattress body 16, and may include metal springs, spring coils, encased spring coils, foam, latex, natural latex, latex w/gel, gel, viscoelastic gel, fluid bladders, or a combination thereof, in one or more layers. The side rails may be placed on one or more of the sides of the mattress body 16, e.g., on all four sides, on opposing sides, on three adjacent sides, or only on one side. In certain embodiments, the side rails may comprise edge supports with a firmness greater than that provided by the mattress body 16. The side rails may be fastened to the stacked mattress layers via adhesives, thermal bonding, or mechanical fasteners.

For ease in manufacturing the mattress assembly, the side rail assembly may be assembled in linear sections that are joined to one another to form the perimeter about the mattress layers. Alternatively, the ends may be mitered or have some other shape, e.g., lock and key type shape.

Figure 3:
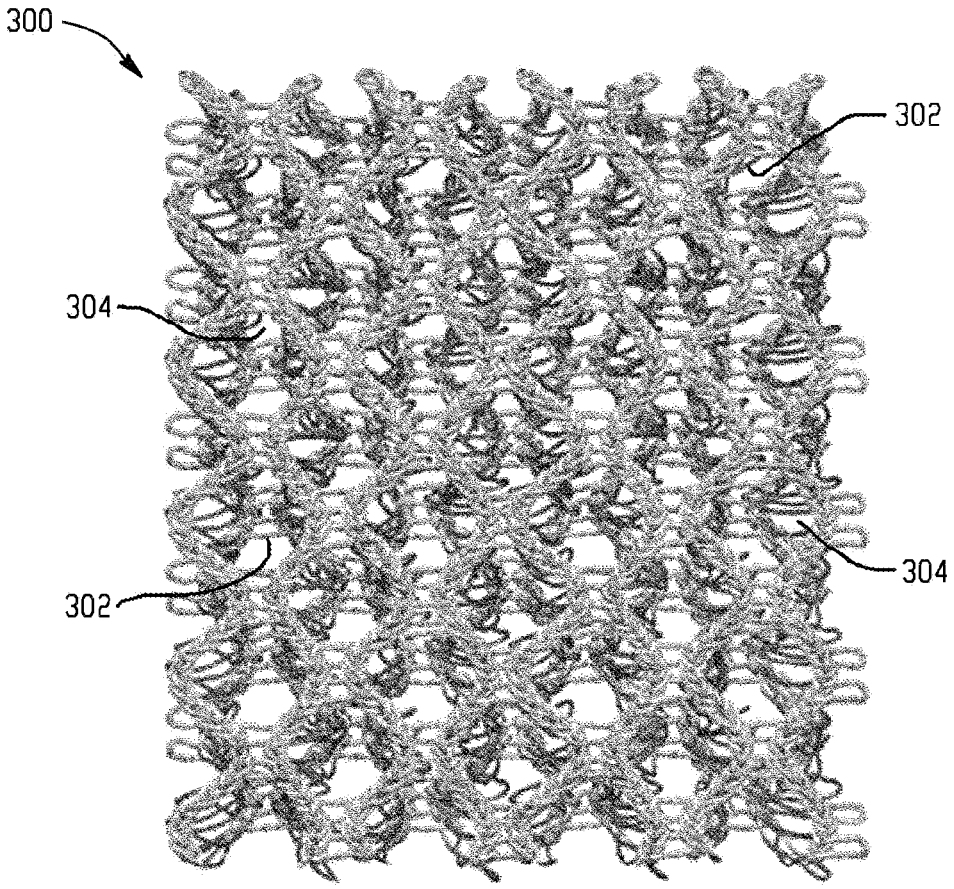
FIG. 3 illustrates a perspective view of an exemplary spacer layer in accordance with an embodiment of the present disclosure.

An exemplary spacer layer 300 formed of polyethylene is pictorially depicted in FIG. 3. As shown, the spacer layer 300 includes a plurality of interconnected fibers 302 defining interstitial spaces 304 throughout the layer 300. The free volume per unit volume, which promotes air flow through the spacer layer, is generally less than 90 percent to greater than 10 percent. In one or more embodiments, the free volume is greater than 80% to less than 20%, and in still other embodiments, the free volume is greater than 60% to less than 30%. The particular spacer layer material and properties are not intended to be limited and are generally selected for use in the mattress assembly for its structural resiliency while maintaining its three-dimensional shape in the presence of a load.

In one or more embodiments, the spacer layer 300 can be formed by first extruding the desired three-dimensional polymer fiber layer. Granules, pellets, chips, or the like of a desired polymer are fed into an extrusion apparatus, i.e., an extruder, at an elevated temperature and pressure, which is typically greater than the melting temperature of the polymer. The polymer, in melt form, is then extruded through a die, which generally is a plate including numerous spaced apart apertures of a defined diameter, wherein the placement, density, and the diameter of the apertures can be the same or different throughout the plate. When different, the three-dimensional polymer fiber layer can be made to have different zones of density, e.g., sectional areas can have different amounts of free volume per unit area. For example, the three dimensional polymer fiber layer can include a frame like structure, wherein the outer peripheral portion has a higher density than the inner portion; or wherein the three dimensional polymer fiber layer has a checkerboard like pattern, wherein each square in the checkerboard has a different density than an adjacent square; or wherein the three dimensional polymer fiber layer has different density portions corresponding to different anticipated weight loads of a user thereof. The various structures of the three-dimensional polymer fiber layer is not intended to be limited and can be customized for any desired application. In this manner, the firmness, i.e., indention force deflection, and/or density of the three-dimensional polymer fiber layer can be uniform or varied depending on the die configuration and conveyor speed.

The fibers are extruded onto a conveyor and subsequently immersed in a cooling bath, which results in entanglement and bonding at coupling points within the entanglement. The rate of conveyance and cooling bath temperature can be individually varied to further vary the thickness and density of the three-dimensional polymer fiber layer. Generally, the thickness of the three-dimensional polymeric fiber layer by itself can be extruded as a full width mattress material at thicknesses ranging from 1 to 6 inches and can be produced to topper sizes or within roll form. However, thinner or thicker thicknesses could also be used as well as wider widths if desired.

Suitable extruders include, but are not limited to continuous process high shear mixers such as: industrial melt-plasticating extruders, available from a variety of manufacturers including, for example, Cincinnati-Millicron. Krupp Werner & Pfleiderer Corp., Ramsey, N.J. 07446, American Leistritz Extruder Corp. Somerville, N.J. 08876; Berstorff Corp., Charlotte, N.C.: and Davis-Standard Div. Crompton & Knowles Corp., Paweatuck, Conn. 06379. Kneaders are available from Buss America, Inc.: Bloomington, Ill.; and high shear mixers alternatively known as Gelimat™ available from Draiswerke G.m.b.H., Mamnheim-Waldhof, Germany; and Farrel Continuous Mixers, available from Farrel Corp., Ansonia, Conn. The screw components used for mixing, heating, compressing, and kneading operations are shown and described in Chapter 8 and pages 458-476 of Rauwendaal, Polymer Extrusion, Hanser Publishers, New York (1986): Meijer, et al., "The Modeling of Continuous Mixers. Part 1: The Corotating Twin-Screw Extruder". Polymer Engineering and Science, vol. 28, No. 5, pp. 282-284 (March 1988): and Gibbons et al., "Extrusion", Modem Plastics Encyclopedia (1986-1987). The knowledge necessary to select extruder barrel elements and assemble extruder screws is readily available from various extruder suppliers and is well known to those of ordinary skill in the art of fluxed polymer plastication.

The extruded polymer fiber structure may be formed from polyesters, polyethylene, polypropylene, nylon, elastomers, copolymers and its derivatives, including monofilament or bicomponent filaments having different melting points The fibers and their characteristics are selected to provide desired tuning characteristics. One measurement of "feel" for a cushion is the indentation-force-deflection, or IFD. Indentation force-deflection is a metric used in the flexible foam manufacturing industry to assess the "firmness" of a sample of foam such as memory foam. To conduct an IFD test, a circular flat indenter with a surface area of 323 square centimeters (50 sq. inches-8" in diameter) is pressed against a foam sample usually 100 mm thick and with an area of 500 mm by 500 mm (ASTM standard D3574). The foam sample is first placed on a flat table perforated with holes to allow the passage of air. It then has its cells opened by being compressed twice to 75% "strain", and then allowed to recover for six minutes. The force is measured 60 seconds after achieving 25% indentation with the indenter Lower scores correspond with less firmness, higher scores with greater firmness. The IFD of the three-dimensional polymer fiber layer tested in this manner and configured for use in a mattress has an IFD ranging from 5 to 25 pounds-force. The density of the three-dimensional polymer fiber layer ranges from 1.5 to 6 $lb/ft^3$.

The pump conduit 28 shown in FIG. 1 can be threaded through the free volume of the spacer layer 24 or provided within a channel 22 formed therein. Moreover, multiple conduits can be used to provide negative or positive air flow to different areas. In one or more embodiments, the conduit 28 is proximate to the channel 22 containing the macroencapsulated phase change material 20.

Figure 4:
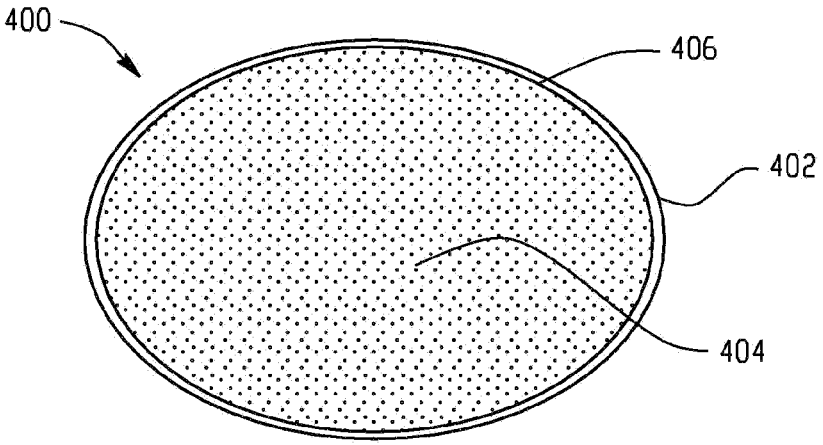
FIG. 4 illustrates a cross-sectional view of a mattress assembly of an exemplary encapsulated bulk phase change material or any other high thermal mass material in accordance with an embodiment of the present disclosure.

FIG. 4 provides a cross sectional view of an exemplary macroencapsulated bulk phase change material 400. The encapsulated bulk phase change material 400 includes a flexible capsulate 402 formed of materials selected to have mechanical properties sufficient to accommodate volume changes that may occur during phase change transitions, withstand the rigors of product durability, and maintain thermal and tactile comfort during use in a variety of end use environments. Disposed within the capsulate 402, is a phase change material 404 or a mixture of phase change materials. In one or more embodiments, the encapsulated bulk phase change material(s) 400 further may include a permeable material 406 such as an open cell foam disposed within the capsulate, wherein the permeable material can be infused with the bulk phase change material or materials and inserted into the capsulate prior to sealing of the capsulate.

Figure 5:
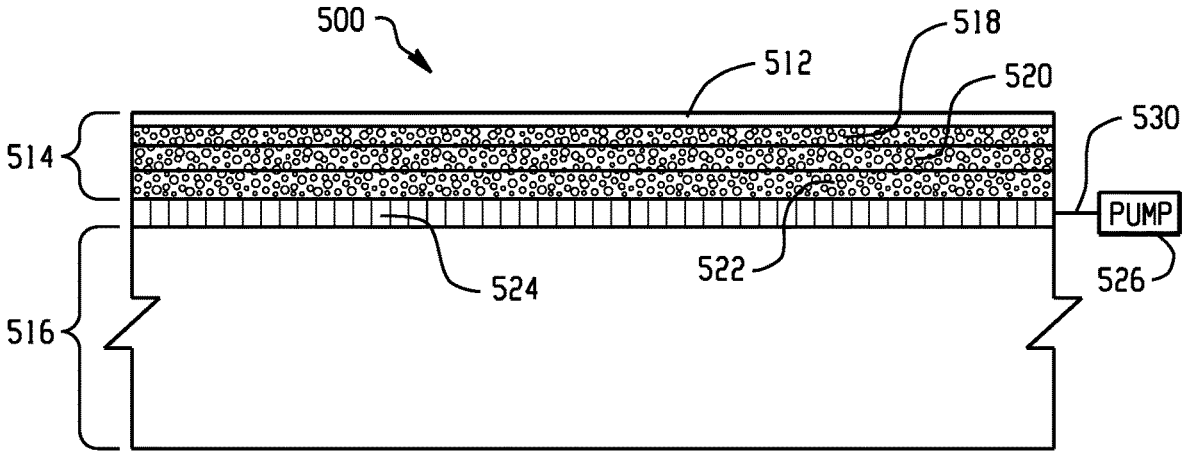
FIG. 5 illustrates a cross-sectional view of a mattress assembly in accordance with an embodiment of the present disclosure.

Turning now to FIG. 5, there is depicted a cross-sectional view of a mattress assembly 500 including a cover layer 512, a topper layer 514 underlying the cover layer 512, and a mattress body 516 underlying the topper layer 514.

The illustrated topper layer 514 overlies the mattress body 516 and includes three foam layers 518, 520, and 522, wherein at least one of the foam layers includes a microencapsulated phase change material infused within at least one of the foam layers and/or coated thereon. A spacer layer 524 is in close proximity and/or underlies the lowermost foam layer including the microencapsulated phase change material. A pump 526 including a conduit 530 is fluidly coupled to the spacer layer 524. The conduit 530 can extend from the pump 526 and into the spacer layer 524 as previously described and can include perforations along the length of the spacer layer 524 to permit air flow into or out of the spacer layer 524 depending on whether the pump 526 is configured to provide positive or negative air flow to remove heat previously absorbed by the phase change material during a sleeping cycle. The pump 526 can be programmed to actuate during a non-sleep cycle. The conduit can be configured to provide positive air flow or a negative air flow to different portions of the foam layer.

Figure 6:
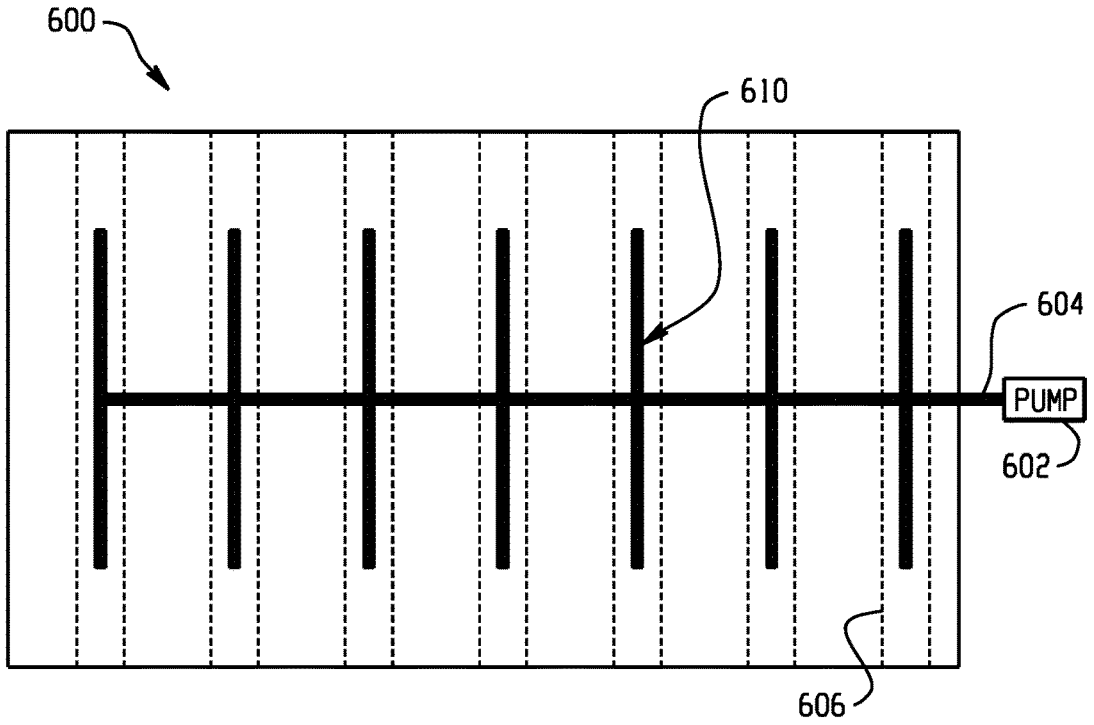
FIG. 6 illustrates a top-down view of a spacer layer including a pump in fluid communication therewith in accordance with an embodiment of the present disclosure.

Turning now to FIG. 6, there is shown a top-down view of a spacer layer 600 including a pump 602 in fluid communication therewith via conduit 604. The conduit 604 is shown connected to an exemplary manifold 610 for distributing the negative or positive air flow from the pump. The distribution of the branches or the manifold in general is not intended to be limited. Optimization to provide maximal heat dissipation is well within the skill of those in the art in view of the present disclosure. The different branches as a illustrated dare aligned with exemplary channels 606 shown in dotted line that may be utilized with macroencapsulated phase change materials as generally discussed in relation to FIGS. 1 and 2. The pump can be actuated during periods of non-use.

Phase change materials, that can be incorporated in the present disclosure, whether utilized for macro- or microencapsulation include a variety of organic and inorganic substances including paraffins; bio-phase change materials derived from acids, alcohols, amines, esters, and the like; salt hydrates; and the like. The particular phase change material or mixtures thereof are not intended to be limited.

Exemplary phase change materials include hydrocarbons (e.g., straight chain alkanes or paraffinic hydrocarbons, branched-chain alkanes, unsaturated hydrocarbons, halogenated hydrocarbons, and alicyclic hydrocarbons), bio-phase change materials derived from fatty acids and their derivatives, (e.g., alcohols, amines, esters, and the like), hydrated salts (e.g., calcium chloride hexahydrate, calcium bromide hexahydrate, magnesium nitrate hexahydrate, lithium nitrate trihydrate, potassium fluoride tetrahydrate, ammonium alum, magnesium chloride hexahydrate, sodium carbonate decahydrate, disodium phosphate dodecahydrate, sodium sulfate decahydrate, and sodium acetate trihydrate), waxes, oils, water, fatty acids, fatty acid esters, dibasic acids, dibasic esters, 1-halides, primary alcohols, aromatic compounds, clathrates, semi-clathrates, gas clathrates, anhydrides (e.g., stearic anhydride), ethylene carbonate, polyhydric alcohols (e.g., 2,2-dimethyl-1,3-propanediol, 2-hydroxymethyl-2-methyl-1,3-propanediol, ethylene glycol, polyethylene glycol, pentaerythritol, dipentaerythritol, pentaglycerine, tetramethylol ethane, neopentyl glycol, tetramethylol propane, 2-amino-2-methyl-1,3-propanediol, monoaminopentaerythritol, diaminopentaerythritol, and tris (hydroxymethyl)acetic acid), polymers (e.g., polyethylene, polyethylene glycol, polyethylene oxide, polypropylene, polypropylene glycol, polytetramethylene glycol, polypropylene malonate, polyneopentyl glycol sebacate, polypentane glutarate, polyvinyl myristate, polyvinyl stearate, polyvinyl laurate, polyhexadecyl methacrylate, polyoctadecyl methacrylate, polyesters produced by polycondensation of glycols (or their derivatives) with diacids (or their derivatives), and copolymers, such as polyacrylate or poly(meth) acrylate with alkyl hydrocarbon side chain or with polyethylene glycol side chain and copolymers comprising polyethylene, polyethylene glycol, polyethylene oxide, polypropylene, polypropylene glycol, or polytetramethylene glycol), metals, and mixtures thereof. Bio-phase change materials have high latent heat, small volume change for phase transition, sharp well-defined melting temperature and reproducible behavior.

The selection of a phase change material will typically be dependent upon a desired transition temperature. For example, a phase change material having a transition temperature slightly above room temperature but below skin temperature may be desirable for mattress applications to maintain a comfortable temperature for a user.

A suitable phase change material can have a phase transition temperature within a range of about 22° to about 36° C. In one or more other embodiments, the transition temperature within a range of about 25° C. to about 30° C. With regard to paraffin phase change materials, the number of carbon atoms of a paraffinic hydrocarbon typically correlates with its melting point. For example, n-octacosane, which contains twenty-eight straight chain carbon atoms per molecule, has a melting point of 61.4° C. whereas n-tridecane, which contains thirteen straight chain carbon atoms per molecule, has a melting point of −5.5° C. According to an embodiment of the disclosure, n-octadecane, which contains eighteen straight chain carbon atoms per molecule and has a melting point of 28.2° C., is particularly desirable for mattress applications. Additionally, coconut fats and oils can be suitable used as a phase change material for mattress applications, which can be selected to have a melting temperature of 19 to 34° C.

Other useful phase change materials include polymeric phase change materials having transition temperatures within a range of about 22° to about 36° C. in one or more embodiments, and a transition temperature within a range of about 26° to about 30° C. in other embodiments. A polymeric phase change material may comprise a polymer (or mixture of polymers) having a variety of chain structures that include one or more types of monomer units. Polymeric phase change materials may include linear polymers, branched polymers (e.g., star branched polymers, comb branched polymers, or dendritic branched polymers), or mixtures thereof. A polymeric phase change material may comprise a homopolymer, a copolymer (e.g., terpolymer, statistical copolymer, random copolymer, alternating copolymer, periodic copolymer, block copolymer, radial copolymer, or graft copolymer), or a mixture thereof. As one of ordinary skill in the art will understand, the reactivity and functionality of a polymer may be altered by addition of a functional group such as, for example, amine, amide, carboxyl, hydroxyl, ester, ether, epoxide, anhydride, isocyanate, silane, ketone, and aldehyde. Also, a polymer comprising a polymeric phase change material may be capable of crosslinking, entanglement, or hydrogen bonding to increase its toughness or its resistance to heat, moisture, or chemicals.

Table 1 provides a list of exemplary commercially available phase change materials and the corresponding metal point (Tm) suitable for use in mattress applications described herein.

TABLE 1

| Material | Supplier | Type | Form | Melting point, Tm |
|---|---|---|---|---|
| 0500- Q28 BiOPCM | Phase Change Energy Solutions | Functionalized BioPCM | Bulk, Macro-encapsulated | 28° C. (82° F.) |
| PureTemp 28 | PureTemp LLC | Organic | Bulk | 28° C. (82° F.) |
| RT27 | Rubitherm GmbH | Organic | Bulk | 28° C. (82° F.) |
| Climsel C28 | Climator | Inorganic | Bulk | 28° C. (82° F.) |
| RT 30 | Rubitherm | Organic | Bulk | 28° C. (82° F.) |

TABLE 1-continued

| Material | Supplier | Type | Form | Melting point, Tm |
|---|---|---|---|---|
| | GmbH | | | |
| RT 28 HC | Rubitherm GmbH | Organic | Bulk | 28° C. (82° F.) |
| A28 | PlusICE | Organic | Bulk | 28° C. (82° F.) |
| MPCM 28 | Microtek | Organic | Micro-encapsulated | 28° C. (82° F.) |
| MPCM 28D | Microtek | Organic | Micro-encapsulated | 28° C. (82° F.) |
| Latest 29 T | TEAP | Inorganic | Bulk | 28° C. (82° F.) |
| 0500-Q29 BiOPCM | Phase Change Energy Solutions | Function-alized BioPCM | Bulk, Macro-encapsulated | 29° C. (84° F.) |
| 29 $C^0$ Infinite R | Insolcorp | Inorganic | Macro-encapsulated | 29° C. (84° F.) |
| savE HS29 | Pluss | Inorganic | Bulk | 29° C. (84° F.) |
| savE OM 29 | Pluss | Organic | Bulk | 29° C. (84° F.) |
| savE FS 29 | Pluss | Organic | Bulk | 29° C. (84° F.) |
| PureTemp 29 | PureTemp LLC | Organic | Bulk | 29° C. (84° F.) |
| TH 29 | TEAP | Inorganic | Bulk | 29° C. (84° F.) |
| A29 | PlusICE | Organic | Bulk | 29° C. (84° F.) |
| PCM-HS29P | SAVENRG | Inorganic | Bulk | 29° C. (84° F.) |
| CrodaTherm ™ 29 | Croda International Plc | Organic | Bulk | 29° C. (84° F.) |
| 0500-Q30 BioPCM | Phase Change Energy Solutions | Function-alized BioPCM | Bulk, Macro-encapsulated | 30° C. (86° F.) |
| S30 | PlusICE | Inorganic | Bulk | 30° C. (86° F.) |
| savE OM 30 | Pluss | Organic | Bulk | 31° C. (88° F.) |
| savE FS 30 | Pluss | Organic | Bulk | 31° C. (88° F.) |
| RT31 | Rubitherm GmbH | Organic | Bulk | 31° C. (88° F.) |
| 0500-Q32 BioPCM | Phase Change Energy Solutions | Function-alized BioPCM | Bulk, Macro-encapsulated | 32° C. (90° F.) |
| savE OM 32 | Pluss | Organic | Bulk | 32° C. (90° F.) |
| Climsel C32 | Climator | Inorganic | Bulk | 32° C. (90° F.) |
| S32 | PlusICE | Inorganic | Bulk | 32° C. (90° F.) |
| A32 | PlusICE | Organic | Bulk | 32° C. (90° F.) |
| PCM-OM32P | SAVENRG | Organic | Bulk | 32° C. (90° F.) |

Advantageously, the present disclosure provides mattress assemblies and processes therein that can effectively recharge the phase change material between sleep cycles. The processes generally include actuating a pump during non-use (i.e., between sleeping cycles) to dissipate heat that may be retained by the foam layers including phase change materials, whether it be macroencapsulated and/or microencapsulated. Actuation of the pump provides a negative or positive air flow. The pump can run for a predetermined time or can be coupled to a temperature sensor configured to measure temperature of the phase change materials. The negative or positive air flow can advantageously remove moisture from mattress such as may occur from use, i.e., sweat, or environmental humidity. Sensors could be integrated therein to insure that excess heat and humidity have been removed from the bed. As such, bed odor would also be reduced as well as a reduction in humidity attracted microbes and dust mites. Moreover, because the process including running the pump during the day when you are not in your bed, pump noise would not be an issue allowing mattress manufacturers to use a variety of pumps. This mattress system will improve the quality of sleep by maximizing the sleep experience every night for the ultimate sleep experience.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly including a sleeping surface comprising:

one or more foam layers containing a phase change material, the one or more foam layers spanning at least a portion of a length and/or a width of the sleeping surface;

an air permeable layer in proximity to the one or more foam layers containing the phase change material; and a pump in fluid communication with a single layer of conduit spanning about a length and width dimension of the mattress assembly, wherein the single layer of conduit is in fluid communication with the air permeable layer, and wherein the pump is configured to provide positive air flow or negative air flow into the air permeable layer to dissipate a thermal load associated with the phase change material in the one or more foam layers during periods of non-use, wherein the one or more foam layers including the phase change material has a parallelpiped-shape, and wherein the conduit is fluidly coupled to a manifold to provide distribution of the positive or negative air flow across length and width dimension of the parallelpiped-shape.

2. The mattress assembly of claim 1, wherein the pump is configured to actuate during a non-sleeping cycle.

3. The mattress assembly of claim 1, wherein the phase change material in the one or more layers of foam is arranged in a zone corresponding to a selected one or more of the head and foot region, the lumbar region, and/or the leg and foot region of an end user.

4. The mattress assembly of claim 1, wherein the phase change materials are macroencapsulated phase change materials and provided within channels or recesses in the one or more foam layers.

5. The mattress assembly of claim 1, wherein the phase change materials are microencapsulated phase change materials deposited onto surfaces and/or infused into the one or more foam layers.

6. The mattress assembly of claim 4, wherein the macroencapsulated phase change material comprises a sealed flexible capsulate, and an open cell foam infused with the phase change material or a mixture of phase change materials.

7. The mattress assembly of claim 6, wherein the air permeable layer comprises a spacer layer, a reticulated foam layer or an open cell foam layer.

8. The mattress assembly of claim 1, wherein the at least one foam layer is a topper layer underlying a cover layer and overlying a mattress body to define the mattress assembly.

9. The mattress assembly of claim 1, wherein the air permeable layer abuts the one or more foam layers containing the phase change material.

10. The mattress assembly of claim 1, wherein the phase change material has a melting point in a range of about 22° C. to about 36° C.

11. A process for dissipating retained heat from a phase change material provided in at least one foam layer of a mattress assembly, wherein the heat is retained during a first sleep cycle, the process comprising:

providing an air permeable layer in the mattress assembly, wherein the air permeable layer is in proximity to the at least one foam layer containing the phase change material; and negatively or positively flowing air from a pump after the first sleep cycle and prior to an additional sleep cycle into the air permeable layer via a single layer of conduit in fluid communication therewith to dissipate the retained heat within the phase change material wherein the at least one foam layer including the phase change material has a parallelpiped-shape, and wherein a conduit is fluidly coupled to a manifold to provide distribution of the negatively or positively flowing air across length and width dimension of the parallelpiped-shape.

12. The process of claim 10, wherein negatively or positively flowing air comprises receiving feedback from a load sensor indicative of zero load.

13. The process of claim 10, wherein the phase change material is a macroencapsulated phase change material and the at least one foam layer comprises channels or recesses configured to receive the macroencapsulated phase change material, wherein the conduit includes perforations aligned with the recesses or channels and configured to direct the negative or positive air flow to the macroencapsulated phase change material.

14. The process of claim 13, wherein the macroencapsulated phase change material comprises a sealed flexible capsulate, an open cell foam within the capsulate, and the phase change material infused within the permeable material.

15. The process of claim 10, wherein the air permeable layer is a spacer layer having a free volume of less than 90 percent to greater than 10 percent per unit area.

16. The process of claim 10, wherein the phase change material is microencapsulated.

17. The process of claim 10, wherein the phase change material has a melting point in a range of about 22° C. to about 36° C.

18. The process of claim 10, wherein actuating the pump comprises detecting an absence of a load on the mattress assembly.

19. A mattress assembly comprising:

a topper layer overlying a mattress body, the topper layer comprising one or more foam layers, wherein at least one foam layer comprises a plurality of channels and a macroencapsulated phase change material disposed in at least one or the channels, the macroencapsulated phase change material comprising a sealed flexible capsulate, a permeable material within the capsulate, and a phase change material infused within the permeable material;

a spacer layer abutting the at least one foam layer comprising the plurality of channels and the macroencapsulated phase change material disposed in at least one or the channels;

a pump in fluid communication with the spacer layer via a single layer of conduit, wherein the pump is configured to provide a positive air flow or a negative air flow, and wherein the conduit is fluidly coupled to a perforated conduit within the spacer layer including perforations directed at the macroencapsulated phase change material in at least one or the channels wherein the at least one foam layer comprises the plurality of channels and the macroencapsulated phase change material disposed in at least one or the channels has a parallelpiped-shape, and wherein a conduit is fluidly coupled to a manifold to provide distribution of the positive air flow or the negative air flow across length and width dimension of the parallelpiped-shape.

20. The mattress assembly of claim 19, wherein the perforated conduit is aligned with the channels.

21. The mattress assembly of claim 19, wherein the permeable material is an open cell foam.

22. The mattress assembly of claim 19, wherein the pump provides the positive air flow or the negative air flow based on a signal from a timer.

23. The mattress assembly of claim 19, further comprising one or more sensors comprising a temperature sensor, a humidity sensor, a load sensor or a combination thereof integrated into the mattress assembly, wherein the pump is configured to actuate upon an absence of a load on the mattress assembly, upon detection of a temperature within the mattress assembly that is elevated relative to an ambient temperature about the mattress assembly, and/or upon detection of a humidity level within the mattress assembly elevated relative to an ambient environment about the mattress assembly and wherein the pump is deactivated when a load is detected, and/or when an programmed amount of heat and/or humidity has been removed from the mattress assembly.

* * * * *